US007537288B2

(12) United States Patent
Chiang

(10) Patent No.: US 7,537,288 B2
(45) Date of Patent: May 26, 2009

(54) TOOL HOLDING DEVICE

(75) Inventor: Chun-Li Chiang, Taichung (TW)

(73) Assignee: Everpads Co., Ltd., Taichung (TW)

( * ) Notice: Subject to any disclaimer, the term of this patent is extended or adjusted under 35 U.S.C. 154(b) by 0 days.

(21) Appl. No.: 11/863,168

(22) Filed: Sep. 27, 2007

(65) Prior Publication Data

US 2009/0085396 A1 Apr. 2, 2009

(51) Int. Cl.
*E21C 35/193* (2006.01)

(52) U.S. Cl. ..... 299/102

(58) Field of Classification Search ..... 299/100–113
See application file for complete search history.

(56) References Cited

U.S. PATENT DOCUMENTS 4,346,934 A * 8/1982 College et al. ..... 299/109
5,106,166 A * 4/1992 O'Neill ..... 299/104

FOREIGN PATENT DOCUMENTS

EP 771911 A1 * 5/1997

* cited by examiner

*Primary Examiner*—Sunil Singh
(74) *Attorney, Agent, or Firm*—Pai Patent & Trademark Law Firm; Chao-Chang David Pai; Jeffrey R. Ouimet

(57) ABSTRACT

A tool holding device is disclosed, and the tool holding device includes a base, a block, and a fastening member for securing the block. The base includes a receiving portion defined between a countering wall and a shoulder wall, a surface defined adjacent to the shoulder wall perpendicularly and away from the countering wall, a penetrated hole defined on the countering wall, and a positioning hole communicating with the penetrated hole. The block includes a holding portion held in the receiving portion, a handle received in the penetrated hole, and a holding hole for holding a chisel. The countering wall and the shoulder wall define an angle less than or equal to 90 degrees. Therefore, the counterforce bearing of the base and block are both enhanced to raise the strength of the tool holding device.

10 Claims, 7 Drawing Sheets

TOOL HOLDING DEVICE

BACKGROUND

1. Field of Invention

The present invention relates to a holding device, and more particularly a tool holding device for a road planer.

2. Description of Related Art

A cutter holder and a tool holding device for the road planer are shown in EP 1761682 and US 2006/0119165. The cutter holder and the tool holding device respectively include a base and a block wherein the base is welded on the peripheral surface of the working member (ex. roller) and the block is secured on the base through a fastening member to receive a tool (such as a chisel). The tool received in the block is located along a tangent of the roller to dig into the earth for planning, excavating or milling operation.

When the road planer works, the tool bit is forced to drill and excavate as the roller rotates such that the processed material (such as concrete and asphalt) coated on the road surface can be removed. In addition, the tough processed material shortens the lifetime of the tool and results in frequent replacements of the tool. However, the counterforce resulting from the operation is stressed on both the base and the block such that extensive replacement and large costs arise because of the inferior tightness between the base and the block.

Therefore, raising the connection strength of the tool holding device to overcome the tough processed material is important. Because the counterforce resulting from the operation of the road planer is stressed on both the base and the block, the block may wear out or even break after a long operation period. As a result, reinforcing the connection strength between the base and the block of the tool holding device, extending the use period, and reducing cost is the aim of the present invention.

SUMMARY

It is therefore an aspect to provide a tool holding device to enhance the counterforce bearing of the shoulder wall and the countering wall by clamping the block within the receiving portion with a non-obtuse angle.

It is therefore another aspect to provide a tool holding device to reinforce the connection strength between the base and the block through the protrusion embedded within the track in the form of a dovetail, and the retaining portion of the block obstructed against the surface of the base.

It is therefore another aspect to provide a tool holding device wherein the groove conducts the fragments during the operation to prevent them from getting stuck and deteriorating the performance of the chisel.

In accordance with an embodiment of the present invention, the tool holding device includes a base, a block and a fastening member wherein the bottom of the base is welded on a peripheral surface of the roller. The base includes a receiving portion defined between a shoulder wall and a countering wall, a surface defined adjacent to the shoulder wall perpendicularly and away from the countering wall, a penetrated hole defined on the countering wall along an axis, and a positioning hole communicating with the penetrated hole. The shoulder wall and the countering wall define an angle less than or equal to 90 degrees.

The block is detachably set on the base, and includes a holding portion held in the receiving portion, a handle extended outward from the holding portion and received in the penetrated hole, and a holding hole defined through the holding portion and the handle along the axis for holding the chisel. The handle is perpendicular to the countering wall of the base, and the angle between the shoulder wall and the countering wall is non-obtuse such that the counterforce bearing for the base and block are both enhanced. The fastening member is fixed in the positioning hole and against the handle to secure the block.

The block further includes a retaining portion protruding from the holding portion outward along a radial direction of the holding hole and against the surface of the base. The base includes a track formed on the shoulder wall, and the block includes a corresponding protrusion movably received in the track. In addition, the base includes a groove formed on a junction between the countering wall and the shoulder wall and communicating with the opposite flanks of the base to provide the fragments conduction.

As a result, the tool holding device of the present invention has greater mechanical strength wherein the connection strength between the base and the block is also enhanced. Accordingly, the replacement times are decreased and the material cost is also reduced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
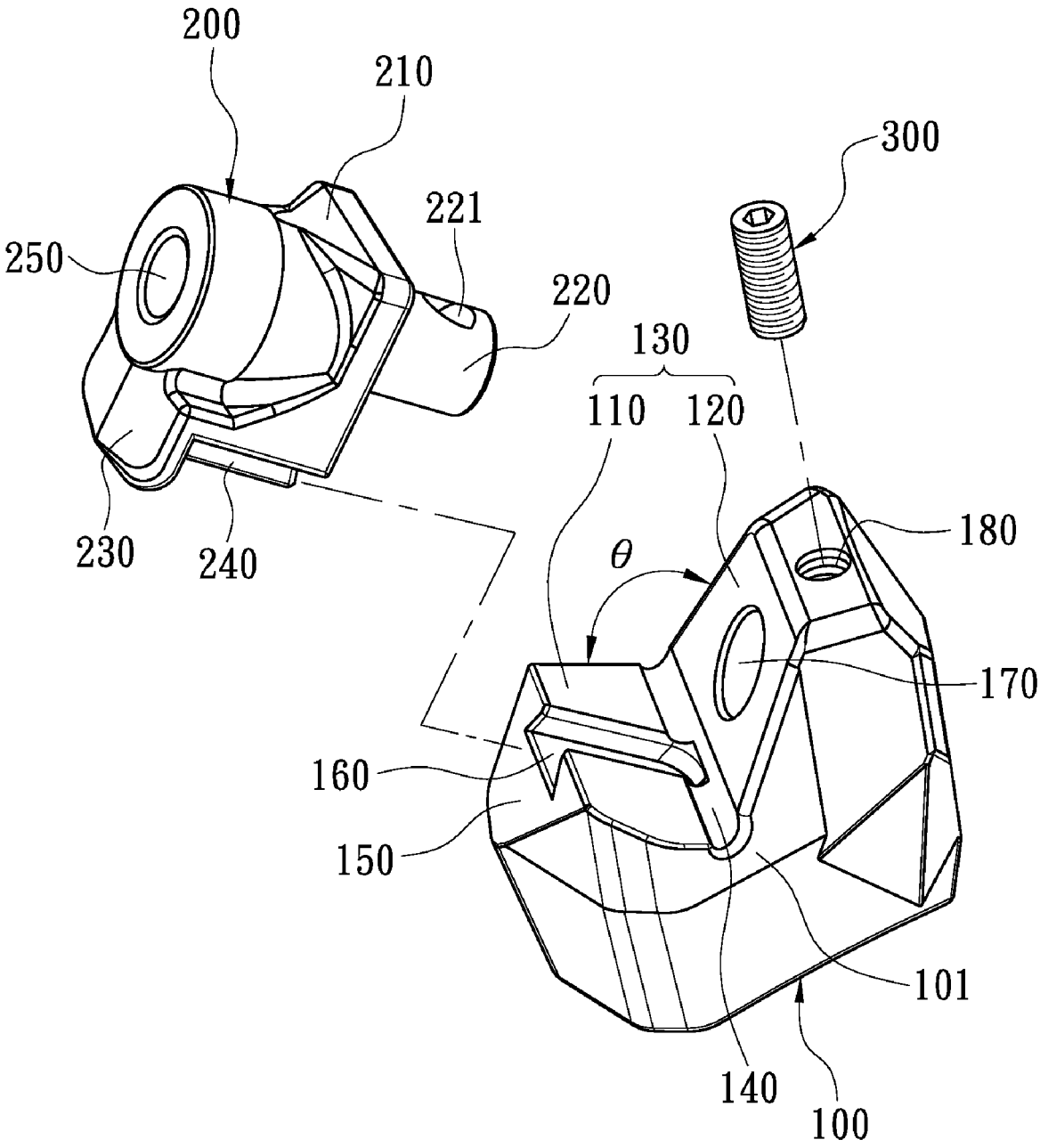
FIG. 1 is an exploded view of a first embodiment of the tool holding device in accordance with the present invention.

Reference will now be made in detail to the present preferred embodiments of the invention, examples of which are illustrated in the accompanying drawings. Wherever possible, the same reference numbers are used in the drawings and the description to refer to the same or like parts.

While the specification concludes with claims defining the features of the invention that are regarded as novel, it is believed that the invention will be better understood from a consideration of the following description in conjunction with the figures, in which like reference numerals are carried forward.

Figure 2:
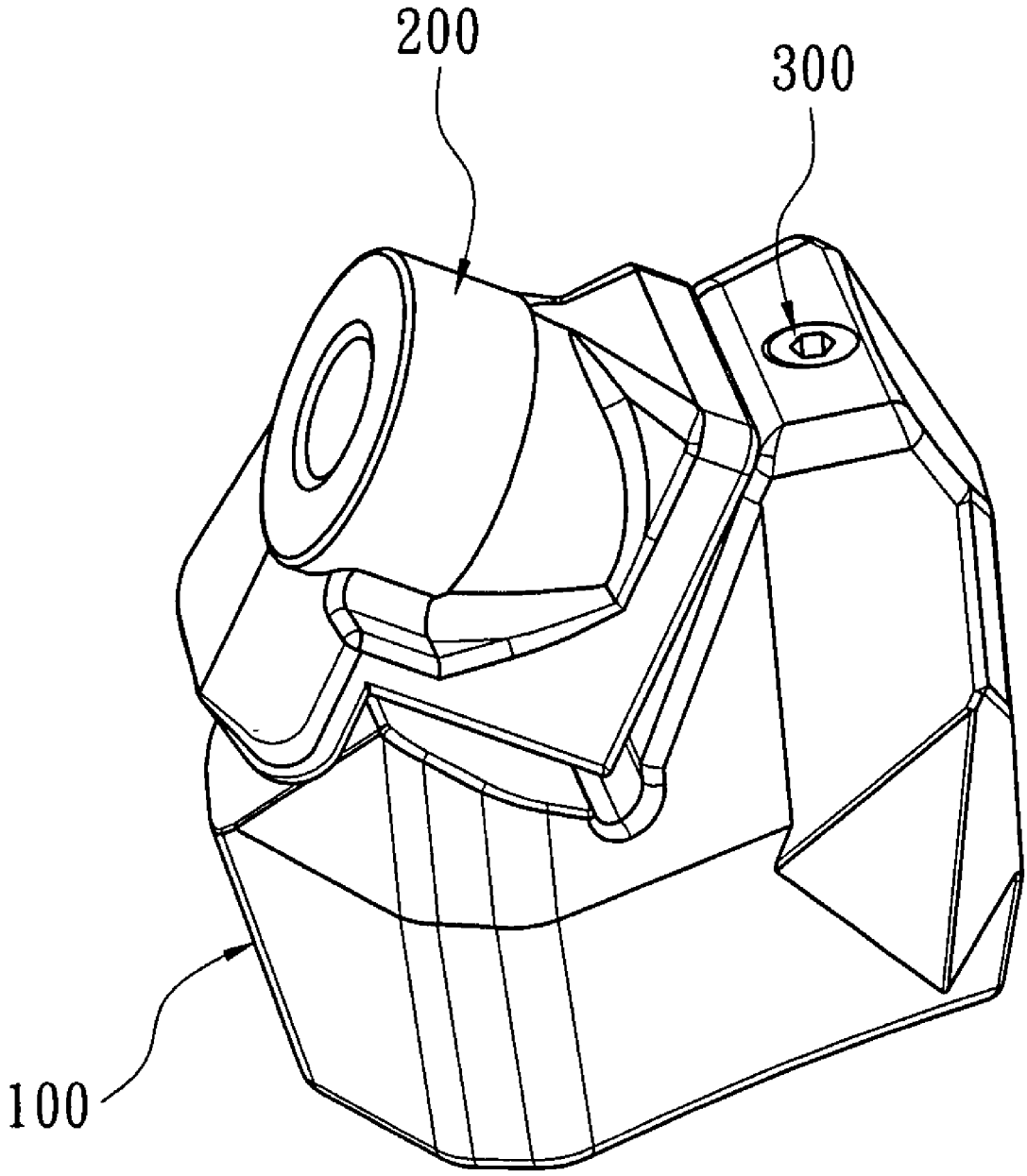
FIG. 2 is a perspective view of the tool holding device in accordance with FIG. 1.

Refer to FIG. 1 and FIG. 2. FIG. 1 illustrates an exploded view of a first embodiment of the tool holding device in accordance with the present invention; FIG. 2 illustrates a perspective view of the tool holding device in accordance with FIG. 1.

The tool holding device includes a base 100, a block 200 and a fastening member 300. The tool holding device is fixed on a roller 510 of a road planer 500 to receive a chisel 400 to dig and mill the road surface (shown in FIG. 5).

Figure 3:
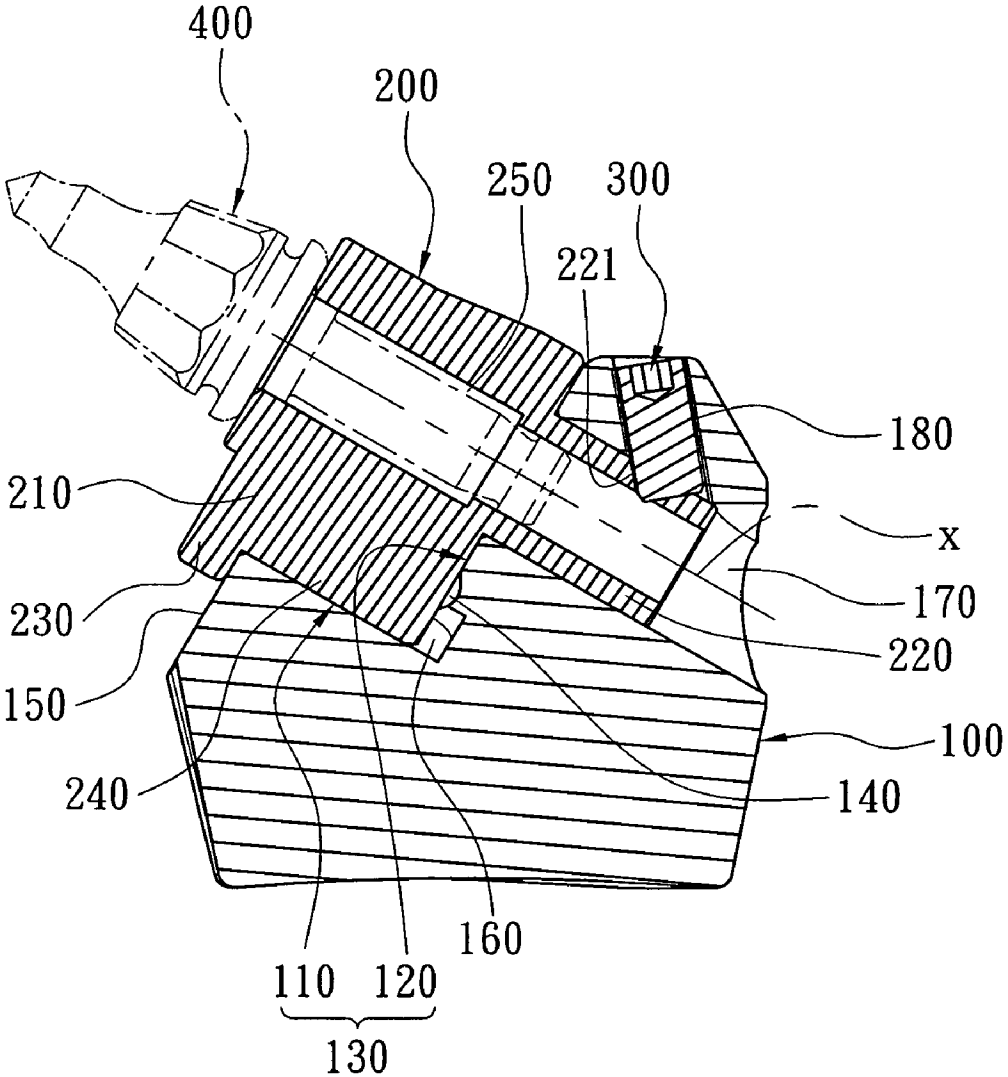
FIG. 3 is a sectional view of the tool holding device in accordance with FIG. 2.
Figure 5:
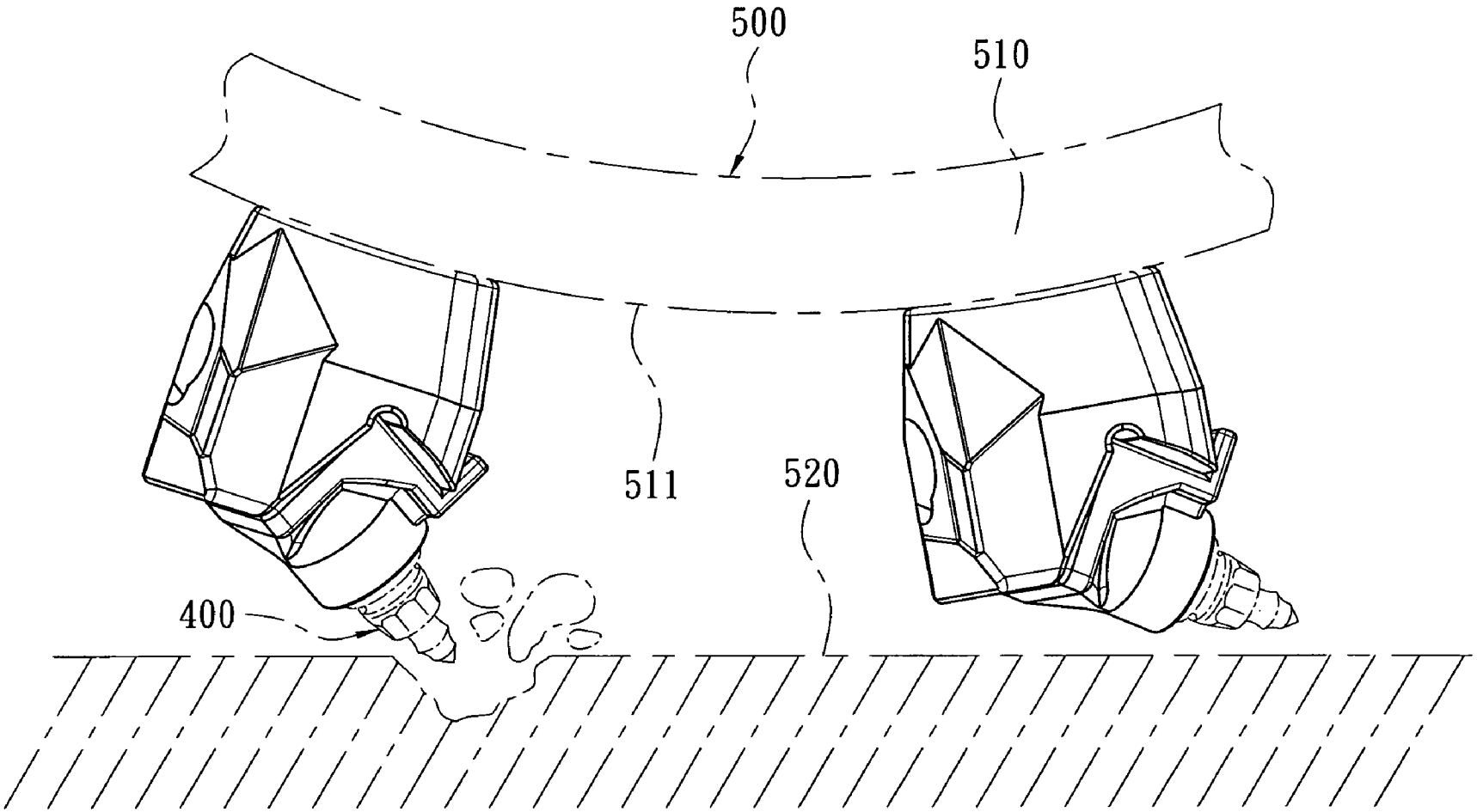
FIG. 5 is an operating schematic view of the tool holding device in accordance with the present invention.

Refer to FIG. 1, FIG. 3 and FIG. 5. FIG. 3 illustrates a sectional view of the tool holding device in accordance with FIG. 2; FIG. 5 illustrates an operating schematic view of the tool holding device of the first embodiment.

The bottom of the base 100 is welded on a peripheral surface 511 of the roller 510 in accordance with the curve of the roller 510. The base 100 includes a receiving portion 130, a groove 140, a surface 150, a track 160, a penetrated hole 170 and a positioning hole 180. The receiving portion 130 is defined between a shoulder wall 110 and a countering wall 120. The groove 140 is formed on a junction between the shoulder wall 110 and the countering wall 120, and communicating with the opposite flanks 101 of the base 100. The surface 150 is defined adjacent to the shoulder wall 110 perpendicularly and away from the countering wall 120. The track 160 is formed on the shoulder wall 110 in a dovetail formation. The penetrated hole 170 is defined on the countering wall 120 along an axis X, and the positioning hole 180 communicates with the penetrated hole 170. In addition, the shoulder wall 110 and the countering wall 120 define an angle θ less than or equal to 90 degrees. In this embodiment, the angle θ is designed in 90 degrees for illustration only.

The block 200 is detachably set on the base 100, and includes a holding portion 210, a handle 220, a retaining portion 230, a protrusion 240 and a holding hole 250. The holding portion 210 is held in the receiving portion 130. The handle 220 is extended outward from the holding portion 210 and received in the penetrated hole 170. The retaining portion 230 is protruded from the holding portion 210 outward along a radial direction of the holding hole 250 and against the surface 150 of the base 100. The protrusion 240 is formed on the holding portion 210 and adjacent to the retaining portion 230 laterally. The holding hole 250 is defined through the holding portion 210 and the handle 220 along the axis X for holding the chisel 400.

Figure 4:
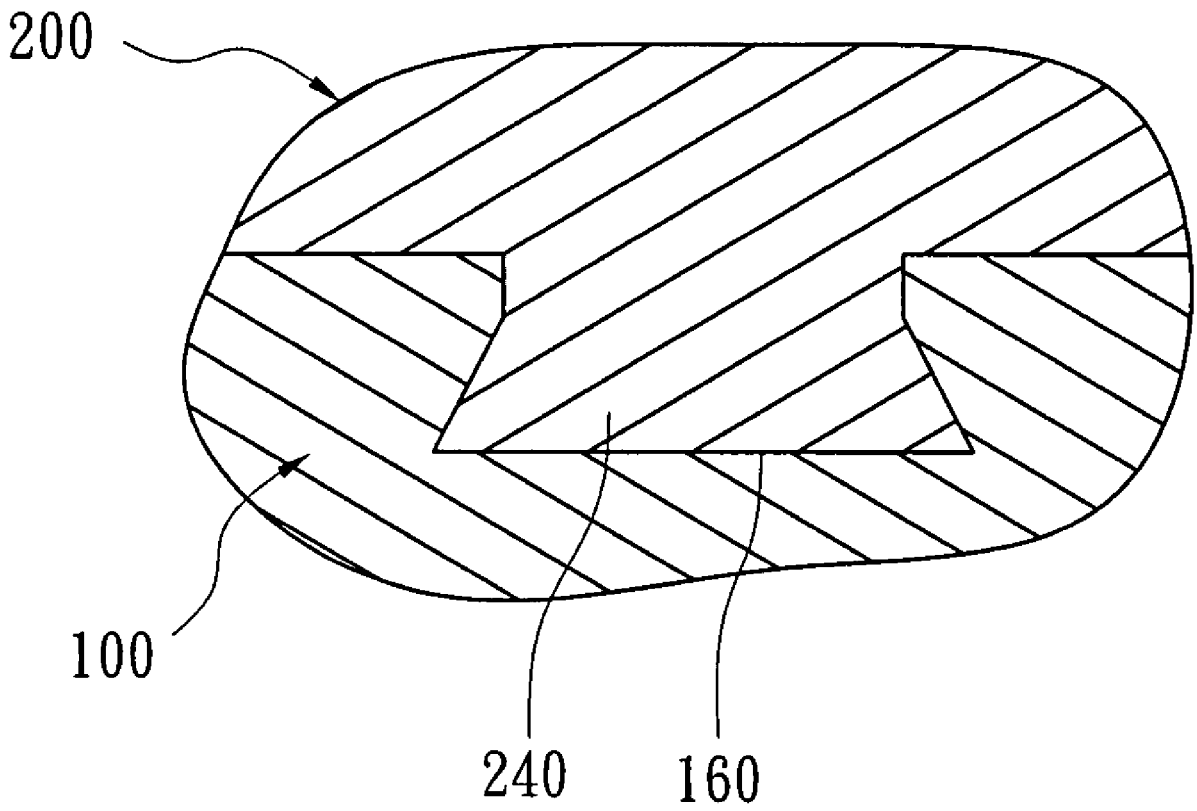
FIG. 4 is a partial sectional view of the tool holding device in accordance with FIG. 2.

Refer to FIG. 4. FIG. 4 illustrates a partial sectional view to show the connection between the protrusion 240 of the block 200 and the track 160 of the base 100. The protrusion 240 of the block 200 is movably received in the track 160 of the base 100 in the form of dovetail. Therefore, the block 200 is firmly secured on the base 100 along the axis X because of the connection between the protrusion 240 and the track 160 and the obstruction effect provided by the retaining portion 230. Moreover, the processed material (such as concrete and asphalt) can be prevented from entering the space between the base 100 and the block 200 during the operation.

The handle 220 of the block 200 further includes an indentation 221 communicating with the positioning hole 180 and holding part of the fastening member 300. In this embodiment, the positioning hole 180 is a threaded hole, and the fastening member 300 is a screw, such as a hex socket cap screw.

In the above mentioned tool holding device of the first embodiment, the receiving portion 130 has a non-obtuse angle (less than or equal to 90 degrees) defined by the shoulder wall 110 and the countering wall 120 whereby the counterforce resulting from the operation (refer to FIG. 5) is stressed on the countering wall 120 directly and also on the shoulder wall 110 because of the oblique between the chisel 400 and the base 100. The non-obtuse angle provides a clamp connection between the base 100 and the block 200, and the holding portion 210 is firmly held in the receiving portion 130 to enhance the mechanical strength of the tool holding device.

The retaining portion 230 with a fan-shaped formation of the block 200 is obstructed against the surface 150 of the base 100 to provide the block 200 a greater stability. In addition, the dovetailed protrusion 240 is embedded within the track 160 of the base 100 such that the block 200 is firmly connected with the base 100. Therefore, the bearing of the block 200 is raised to prevent breaking or cracking, and the use period is extended and the cost is accordingly reduced. The groove 140 is formed on the junction between the shoulder wall 110 and the countering wall 120 to conduct and prevent fragmented processed material from getting stuck and deteriorating the performance of the chisel 400. The oblique surface 150 is used to prevent the ejected processed material from entering the track 160 and scraping the base 100.

Figure 6:
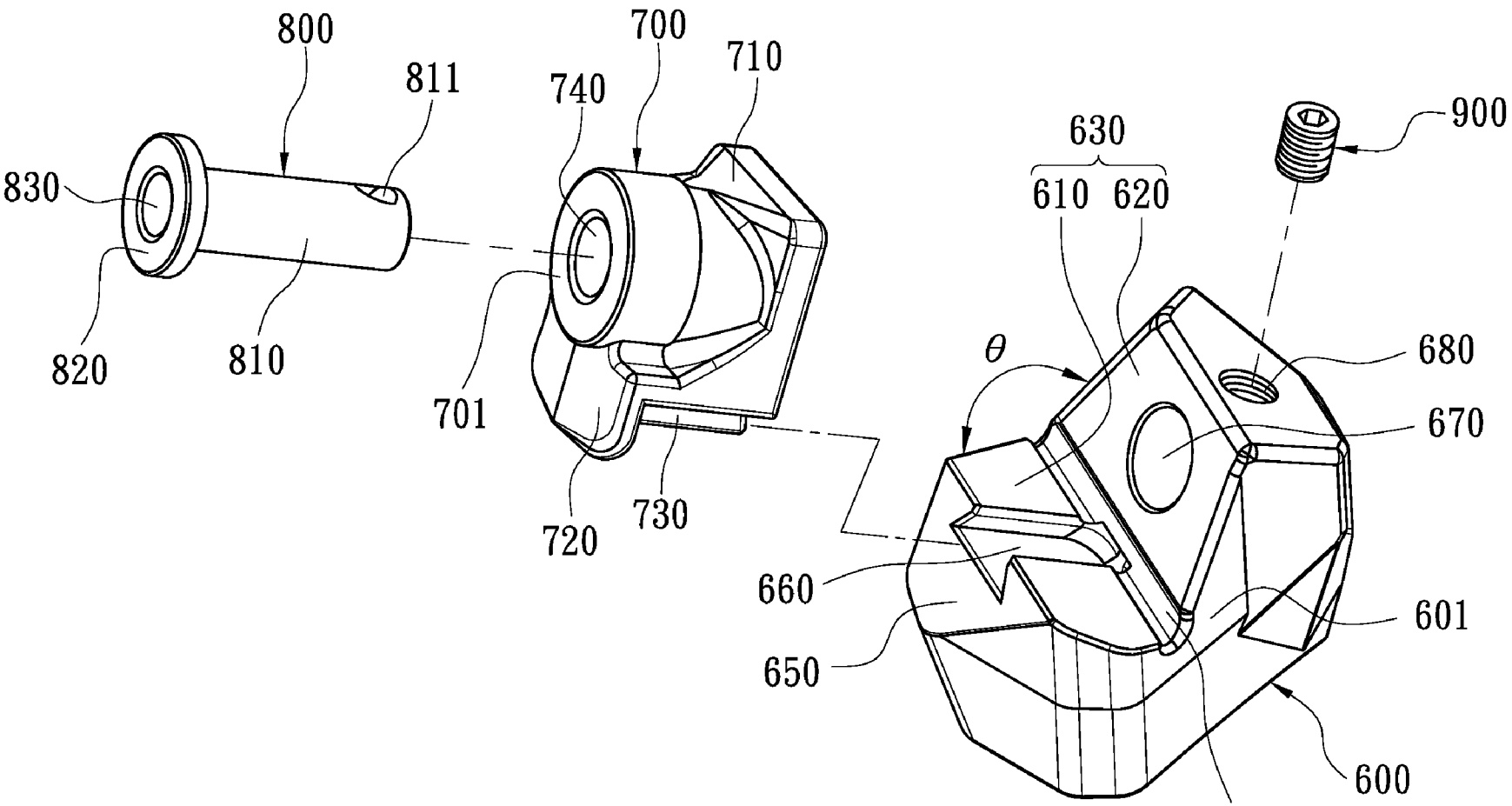
FIG. 6 is an exploded view of a second embodiment of the tool holding device in accordance with the present invention.
Figure 7:
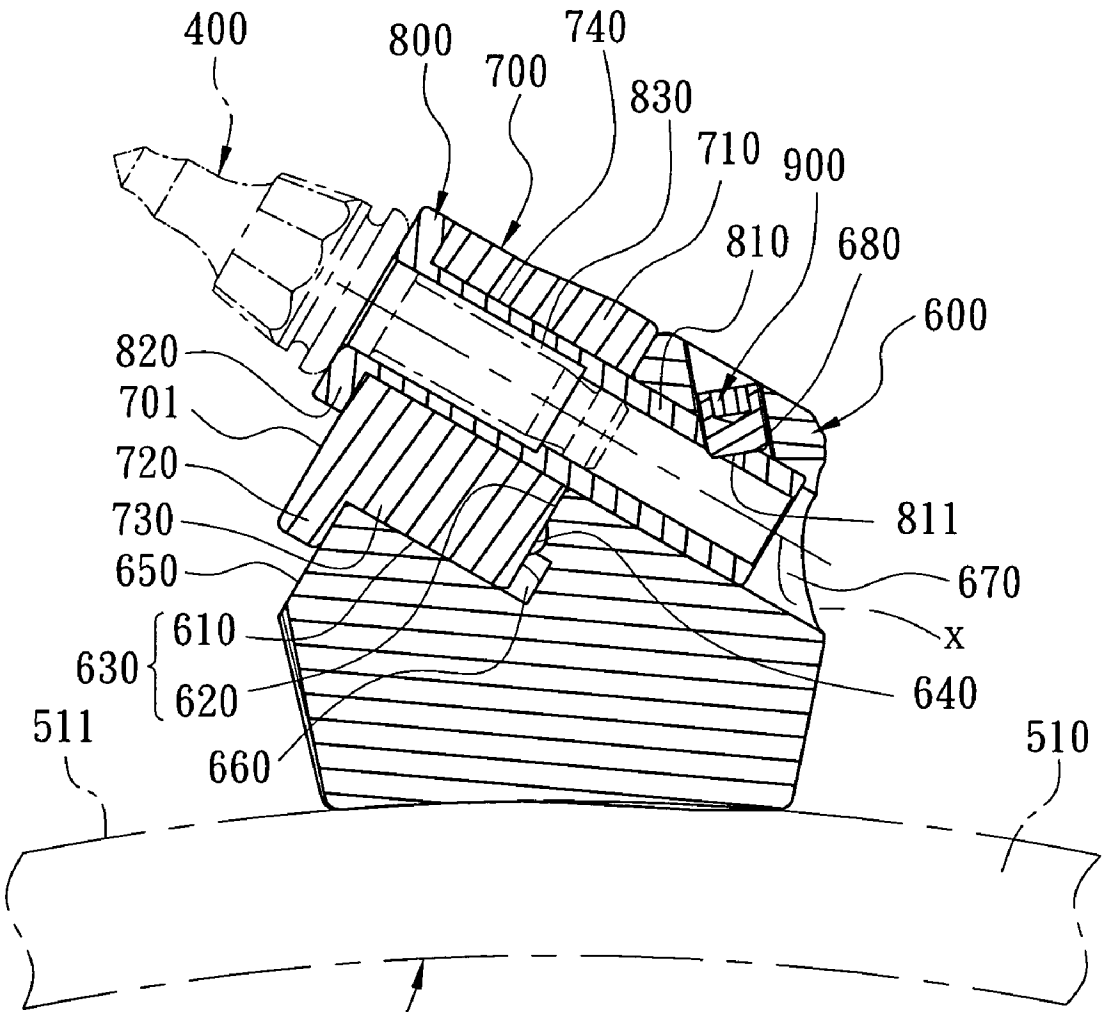
FIG. 7 is a sectional view of the tool holding device of the second embodiment welded on the roller.

Refer to FIG. 6 and FIG. 7. FIG. 6 illustrates an exploded view of a second embodiment of the tool holding device in accordance with the present invention; FIG. 7 illustrates a sectional view of the tool holding device of the second embodiment welded on the roller.

The tool holding device of the second embodiment includes a base 600, a block 700, a sleeve 800, and a fastening member 900. The tool holding device is fixed on a roller 510 of a road planer 500 to receive a chisel 400 to dig and mill the road surface.

The bottom of the base 600 is welded on a peripheral surface 511 of the roller 510 in accordance with the curve of the roller 510. The base 600 includes a receiving portion 630, a groove 640, a surface 650, a track 660, a penetrated hole 670 and a positioning hole 680. The receiving portion 630 is defined between a shoulder wall 610 and a countering wall 620. The groove 640 is formed on a junction between the shoulder wall 610 and the countering wall 620, and communicating with the opposite flanks 601 of the base 600. The surface 650 is defined adjacent to the shoulder wall 610 perpendicularly and away from the countering wall 620. The track 660 is formed on the shoulder wall 610 in a dovetail formation. The penetrated hole 670 is defined on the countering wall 620 along an axis X, and the positioning hole 680 communicates with the penetrated hole 670. In addition, the shoulder wall 610 and the countering wall 620 define an angle θ less than or equal to 90 degrees. In this embodiment, the angle θ is designed in 90 degrees for illustration only.

The block 700 is detachably set on the base 600, and includes a holding portion 710, a retaining portion 720, a protrusion 730 and a holding hole 740. The holding portion 710 is held in the receiving portion 630. The retaining portion 720 is protruded from the holding portion 710 outward along a radial direction of the holding hole 740 and against the surface 650 of the base 600. The protrusion 730 is formed on the holding portion 710 and adjacent to the retaining portion 720 laterally. The holding hole 740 is defined through the holding portion 710 along the axis X. The protrusion 730 of the block 700 is movably received in the track 660 of the base 600 in the form of dovetail. Therefore, the block 700 is firmly secured on the base 600 along the axis X because of the connection between the protrusion 730 and the track 660 and the obstruction provided by the retaining portion 720.

The sleeve 800 is used to hold the chisel 400 and includes a tube 810, a restraining portion 820, and an axial hole 830. The tube 810 is received in the holding hole 740 of the block 700 and the penetrated hole 670 of the base 600. The restraining portion 820 is formed on a front end of the tube 810. The axial hole 830 is defined through the tube 810 and the restraining portion 820 along the axis X. The restraining portion 820 is restrained against an outer surface 701 of the block 700. The tube 810 of the sleeve 800 includes an indentation 811 communicating with the positioning hole 680 of the base 600.

The fastening member 900 is fixed in the positioning hole 680 and against the tube 810 of the sleeve 800 to secure the sleeve 800 wherein part of the fastening member 900 is held in the indentation 811. In this embodiment, the positioning hole 680 is a threaded hole, and the fastening member 900 is a screw.

Therefore, the tool holding device of the second embodiment has greater connection and mechanical strength, and the same fragment conduction and hard-wearing effect as the first embodiment. The difference between the first embodiment and the second embodiment is that the sleeve 800 received in the holding hole 740 of the block 700 is replaceable, and the restraining portion 820 of the sleeve 800 can prevent the processed material from scraping the block 700 during operation to extend the lifetime of the block 700. Consequently, the abrasion area is mostly generated on the sleeve 800 after a long operation period, and only the sleeve 800 is needed to be replaced for reusing the tool holding device. As a result, the material cost resulting from the replacement in the second embodiment is less than the material cost resulting from the replacement in the first embodiment because the replaceable sleeve 800 has a lower cost than the block 200.

As embodied and broadly described herein, the tool holding device of these embodiments in accordance with the present invention have greater mechanical strength wherein the connection strength between the base and the block is also enhanced. The retaining portion of the block and the restraining portion of the sleeve can prevent the block from being rubbed by the processed material during the operation. The groove of the base provides a fragment conduction effect.

Although the present invention has been described in considerable detail with reference to certain preferred embodiments thereof, other embodiments are possible. Therefore, the spirit and scope of the appended claims should not be limited to the description of the preferred embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A tool holding device for fastening to a roller of a road planer, comprising:

a base for fastening to a peripheral surface of the roller, comprising a receiving portion defined between a countering wall and a shoulder wall, a surface defined adjacent to the shoulder wall perpendicularly and away from the countering wall, a penetrated hole defined on the countering wall along an axis, and a positioning hole communicating with the penetrated hole, wherein the countering wall and the shoulder wall define an angle less than or equal to 90 degrees;

a block detachably set on the base, comprising a holding portion held in the receiving portion, wherein the holding portion comprises two walls disposed against the countering wall and the shoulder wall respectively, a handle extending outward from the holding portion and received in the penetrated hole, and a holding hole defined through the holding portion and the handle along the axis of the penetrated hole for holding a chisel; and a fastening member fixed in the positioning hole of the base and against the handle of the block to secure the holding portion.

2. The tool holding device of claim 1, wherein the block comprises a retaining portion protruding from the holding portion outward along a radial direction of the holding hole and against the surface of the base.

3. The tool holding device of claim 1, wherein the base comprises a track formed on the shoulder wall, and the block comprises a protrusion movably received in the track of the base.

4. The tool holding device of claim 1, wherein the base comprises a groove formed on a junction between the countering wall and the shoulder wall, and communicating with opposite flanks of the base to conduct processed material away.

5. The tool holding device of claim 1, wherein the handle of the block comprises an indentation communicating with the positioning hole for holding part of the fastening member.

6. A tool holding device for fastening to a roller of a road planer, comprising:

a base for fastening to a peripheral surface of the roller, comprising a receiving portion defined between a countering wall and a shoulder wall, a surface defined adjacent to the shoulder wall perpendicularly and away from the countering wall, a penetrated hole defined on the countering wall along an axis, and a positioning hole communicating with the penetrated hole, wherein the countering wall and the shoulder wall define an angle less than or equal to 90 degrees;

a block detachably set on the base, comprising a holding portion held in the receiving portion, wherein the holding portion comprises two walls disposed against the countering wall and the shoulder wall respectively, and a holding hole defined through the holding portion along the axis of the penetrated hole;

a sleeve for holding a chisel, comprising a tube received in the holding hole of the block and the penetrated hole of the base, a restraining portion formed on a front end of the tube, and an axial hole defined through the tube and the restraining portion, wherein the restraining portion is restrained against an outer surface of the block; and a fastening member fixed in the positioning hole of the base and against the tube of the sleeve to secure the sleeve.

7. The tool holding device of claim 6, wherein the block comprises a retaining portion protruding from the holding portion outward along a radial direction of the holding hole and against the surface of the base.

8. The tool holding device of claim 6, wherein the base comprises a track formed on the shoulder wall, and the block comprises a protrusion movably received in the track of the base.

9. The tool holding device of claim 6, wherein the base comprises a groove formed on a junction between the countering wall and the shoulder wall, and communicating with opposite flanks of the base to conduct processed material away.

10. The tool holding device of claim 6, wherein the tube of the sleeve comprises an indentation communicating with the positioning hole for holding part of the fastening member.

* * * * *